United States Patent [19]

Benoit

[11] 4,047,332

[45] Sept. 13, 1977

[54] GATE HINGE COMPOSITION

[75] Inventor: Orient Benoit, Acushnet, Mass.

[73] Assignee: New Bedford Wire & Iron Company, New Bedford, Mass.

[21] Appl. No.: 633,687

[22] Filed: Nov. 20, 1975

[51] Int. Cl.[2] ..... E05D 7/06

[52] U.S. Cl. ..... 49/236; 49/386

[58] Field of Search ..... 49/226, 228, 232, 233, 49/236–239, 240–245, 364, 381, 386, 397

[56] References Cited

U.S. PATENT DOCUMENTS

| | | | |
|---|---|---|---|
| 593,324 | 11/1897 | Greene | 49/241 |
| 904,791 | 11/1908 | Manlove | 49/242 |
| 960,268 | 6/1910 | Buellesbach | 49/239 |
| 1,283,359 | 10/1918 | Thomson | 49/381 |
| 1,330,146 | 2/1920 | Solberg | 49/364 |
| 2,693,653 | 11/1954 | Dean, Jr. | 49/364 |
| 2,777,153 | 1/1957 | Markley | 49/386 |

*Primary Examiner*—Peter M. Caun

*Attorney, Agent, or Firm*—Dike, Bronstein, Roberts, Cushman & Pfund

[57] ABSTRACT

This invention relates to an improved hinge for gates, and more particularly, to hinges for chain link fence gates characterized in one embodiment in that they provide automatic gate closing, despite uneven terrain. Further, in a second embodiment, the improved hinge system provides gate openings up to 180°. The expanded mode of operation is effected by offsetting the lower or both hinge pivot points respectively from the center line of the fence. The offset, provided by an improved hinge design including an angular extension of the gate hinge member, is effected while maintaining the coincidence of the center lines of the gate and fence.

1 Claim, 5 Drawing Figures

GATE HINGE COMPOSITION

BACKGROUND OF THE INVENTION

1. Field of the Invention

This invention relates to an improved hinge system for gates and more particularly to hinges for chain link fence gates.

2. Description of the Prior Art

Prior art gate hinge systems designed to effect automatic gate closure are characterized by two possible hinge arrangements. In the first of these, the upper and lower hinges are offset within the same vertical plane by varying their hinge pivot point distances from the swing post. When the lowermost hinge pivot point is nearer the swing post, the gate on opening tends to swing upward such that its closure will be favored by gravitational forces. Such a hinge arrangement is disclosed in U.S. Pat. Nos. 406,412; 626,158 and 2,538,470.

A second prior art hinge arrangement to effect automatic gate closure is characterized by offsetting the upper and lower hinges vertically by varying their point of attachment relative to the center line of the swing post. Such a gate, as disclosed in U.S. Pat. Nos. 570,362 and 1,134,810, on opening tends to swing upward thus closing the gate by the force of gravity.

Within this latter class of hinges, the vertical offset may be effected using identical gate hinge members and displacing the pivotal point of said members by mounting the lower swing post member nearer the front of such post. This arrangement, illustrated in U.S. Pat. No. 570,362, results in the center line of the gate post being offset from the center line of the swing post. Hence the gate in the closed position is neither perpendicular to the ground nor parallel to the fence. Such arrangement is most detrimental to the pleasing appearance of said fence-gate combination.

SUMMARY OF THE INVENTION

It is accordingly the primary object of this invention to provide an improved gate-fence hinge system wherein a gate being both perpendicular to the ground and coplanar with the fence is hinged to favor gravity induced automatic closing.

It is a further object of this invention to provide a similarly improved hinge system wherein a gate, perpendicular to the ground and coplanar with the fence, is able to accommodate 180 degrees of opening.

It is a more specific object of this invention to provide a chain link fence-gate hinge system wherein the center line of the gate corresponds to the center line of the fence through the use of an improved gate-post hinge member, characterized by an angular extension from the center line of said post to the pivot point of the swing post hinge member.

DESCRIPTION OF THE PREFERRED EMBODIMENTS

The novel hinge combinations of this invention may be constructed of any material of sufficient strength to support the weight of the gate, though more preferably, metal or alloys thereof are used. The respective parts may be cast metal but are more preferably of stamped metal bands.

Figure 1:
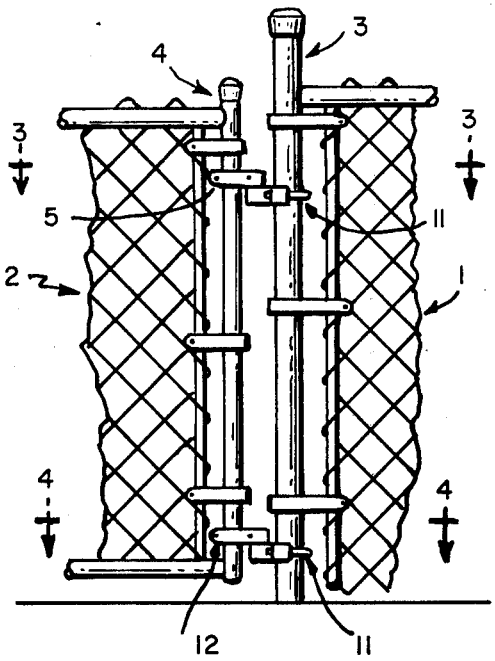
FIG. 1 is an elevational view of a chain link fence having the gate of the invention installed therein.
Figure 2:
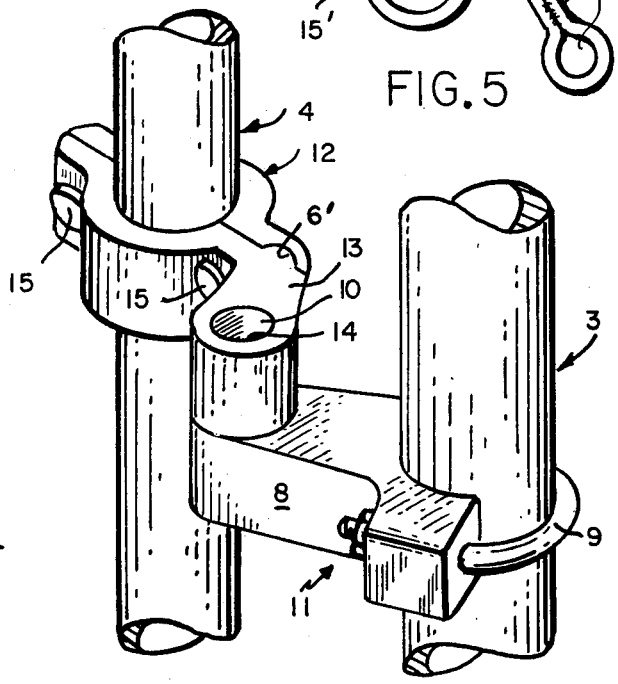
FIG. 2 is an enlarged isometric view of the offset hinge of the invention.

The design and operation of the hinge combination in accordance with this invention are best understood by reference to the drawings. In FIG. 1, a gate 2 including a gate post 4 is interposed in line with a chain link fence 1, including a swing post 3. The gate is connected through the gate post to the swing post of the fence by employing a pair of hinge combinations positioned noncritically near the lower and upper end of said posts.

Figure 3:
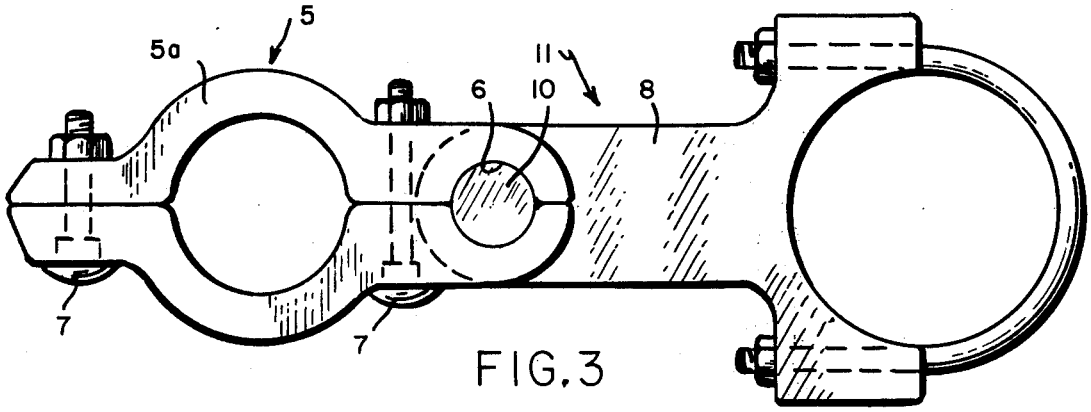
FIG. 3 is a horizontal section taken substantially along the line 3—3 of FIG. 1.

In one embodiment of this invention, the upper hinge combination displayed in FIG. 3 comprises a gate post member 5 in combination with a swing post member 11. Said gate post member comprises two halves **5*a* and 5*b* adjustably connected by two bolt-nutcombination 7 whereby said member can be variably fitted and clamped to said gate post 4 by pressure afforded on tightening. Said gate post member 5 is further characterized by a circular eye 6 formed by the combination of the two halves 5*a* and 5*b*. The swing post member 11 of said upper hinge combination comprises a base 8 including a pivot post 10 on the center line thereof. Said base is fitted tightly to the swing post 3 by a post encircling combination 9. The two members are attached to their respective posts such that the center line of the fence and gate is also the center line of the eye 6 and pivot post 10**. Insertion of said pivot post in said eye completes the upper hinge combination.

Figure 4:
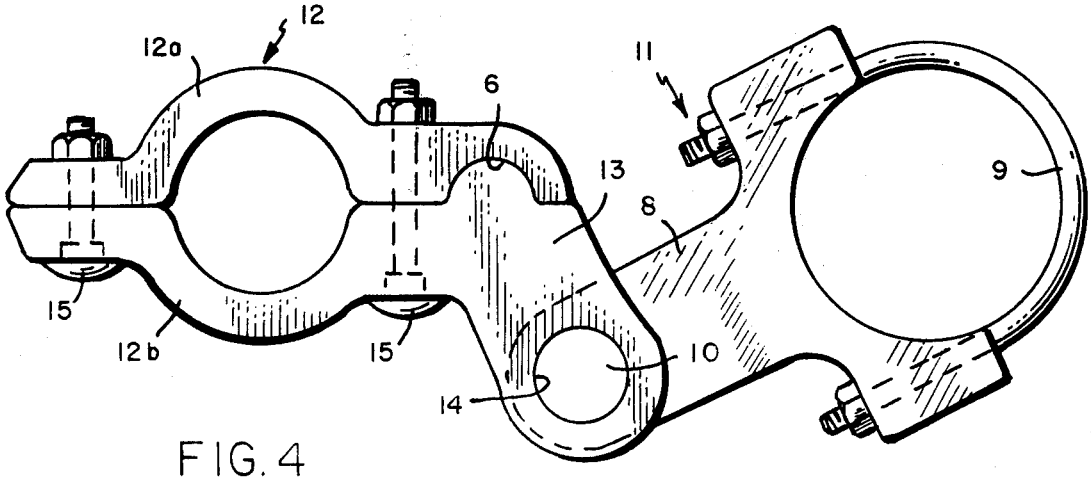
FIG. 4 is a horizontal section taken substantially along the line 4—4 of FIG. 1.

The lower hinge combination, displayed in FIG. 4, comprises a similarly shaped but non equi-dimensional swing post member 11. Conversely, the gate post member 12 comprises two halves **12*a* and 12*b* adjustably connected by two bolt-nut combinations 15 whereby said member can be variably fitted and clamped to said gate post 4 by pressure afforded on tightening. While half 12*a* is identical to half 5*a*, half 12*b* includes an angular extension 13 including therein a circular eye 14. Said extension, protruding from semi-eye 6', corresponding to circular eye 6 of the upper hinge, affords a means of offsetting the pivot point of said lower hinge so as to promote gravitational closing of the opened gate. Member 12 is attached to said gate post such that semi-eye 6' and eye 6 are perpendicularly aligned. Member 11 is rotatably adjusted on the swing post to permit insertion of pivot post 10 in eye 14 and said member then secured via said post encircling means 9** to the swing post.

Figure 5:
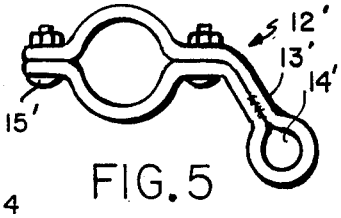
FIG. 5 is a horizontal section of a preferred constuction of the gate post member.

The lower hinge combination displayed in FIG. 4 is typically of cast metal. However, a preferred embodiment of the invention is illustrated in FIG. 5. In this embodiment, the lower hinge combination comprises the same swing post member (not shown in FIG. 5 but in FIG. 4), and a gate post member 12' stamped from metallic strapping rather than cast as in the embodiment depicted in FIG. 4. As with the cast gate post member, the stamped gate post member is adjustably connected by two bolt combinations 15' whereby the member can be variably fitted to the gate post by pressure upon tightening. The stamped gate post member also includes an angular extension 13' including therein a circular eye 14'. In all other respects, gate post member 12' operates in a manner analogous to gate post member 12.

The hinge combination as above described permits lower hinge offsetting to induce gravitation closure yet maintains the gate perpendicularly to the ground and displaced along the same center line as the fence. Such hinge design and arrangement promotes a pleasing geometric appearance to the gate-fence combination and over omes the prior art deficiencies in this regard.

In a second embodiment of this invention, both the upper and lower hinge combinations comprise the offset hinge combination depicted in FIG. 4 and described above. Such a dual-purpose affords easy gate opening to 180°.

It should of course be understood that changes may be made in the specific embodiments described herein without departing from the scope of the invention as defined by the following claims.

I claim:

1. Hinge means for mounting the gate to a fence post within an opening in the fence for gravitational closing from an open position, comprising upper and lower supports for attachment to the fence post and upper and lower hangers for attachment to the gate post, said supports and hangers being adjustably movable on the posts for clamping thereto at corresponding spacing, each support comprising an arm, a pintle pin at one end and two-part clamping means at the other end for encircling the fence post so arranged that the axis of the pintle pin and the axis of the two-part clamping means lie on the longitudinal center line of the arm and are perpendicular thereto, said two-part clamping means comprising at said one end of the arm a transverse part having a substantially half-cylindrical surface which is symmetrical with respect to the center line of the arm, at the opposite ends of which are holes, the axes of which are parallel to the axis of the center line of the arm, a U-shaped band embodying a substantially half-circular part which, in conjunction with the substantially half-cylindrical surface of the transverse part, provides a clamping collar for clamping engagement with the fence post and at its opposite ends straight portions for engagement with said holes and means for securing the straight portions within said holes, said upper hanger comprising two parts of symmetrical configuration adapted to be bolted face-to-face and each part containing longitudinally spaced substantially half-circular openings defining half-circular surfaces of different diameter which collectively define, when the parts are bolted together, a collar for clamping engagement with the gate post and a bearing opening for pivotally receiving the pintle pin of the upper support and said lower hanger comprising two parts adapted to be bolted face-to-face, one of said parts containing longitudinally spaced substantially half-circular openings defining half-circular surfaces corresponding in spacing and size to those of the parts of the upper hanger such that the two halves of the upper hanger and the one-half of the lower hanger are identical and the other one of the parts of the lower hanger containing a half-circular opening corresponding to said substantially half-circular opening of larger diameter in the one part and a substantially half-circular nub protruding from its face for engagement within the substantially half-circular opening of smaller diameter in the one part, and a limb extending from said other one of the parts at an angle to the center line defined by the faces of the parts beyond and laterally of the center line having at its distal end a bearing opening for pivotally receiving the pintle pin of the lower support so that when the gate is hung, a projection of the axis of the pintle pin of the lower support on a line containing the centers of the posts is closer to the axis of the fence post than is the pintle pin on the upper support and that the center lines of the upper and lower hangers coincide with the vertical plane containing the vertical axes of the posts so that the plane of the gate coincides with the plane of the fence when the gate is closed and, when in said closed position, the axis of the lower pintle pin is situated laterally of said plane.

* * * * *